US006406091B1

(12) United States Patent
Saul et al.

(10) Patent No.: US 6,406,091 B1
(45) **Date of Patent: *Jun. 18, 2002**

(54) FOLDING CHAIR

(75) Inventors: Jonathon R. Saul, Erie; David R. Collins, Ida; David E. Harnadek, Franklin; Duane M. Perpich, Ida, all of MI (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/631,042

(22) Filed: Jul. 31, 2000

Related U.S. Application Data

(63) Continuation-in-part of application No. 09/507,318, filed on Feb. 18, 2000.

(51) Int. Cl.[7] ..... A47C 4/30

(52) U.S. Cl. ..... 297/16.2; 297/42; 297/44; 297/45; 297/52

(58) Field of Search ..... 297/16.2, 39, 42, 297/44, 45, 52

(56) References Cited

U.S. PATENT DOCUMENTS

| | | | | | |
|---|---|---|---|---|---|
| 4,359,244 | A | * | 11/1982 | Koehm | 297/16.2 |
| 4,362,315 | A | * | 12/1982 | Kassai | 297/45 X |
| 4,613,185 | A | * | 9/1986 | Marchesini | 297/52 X |
| 4,684,149 | A | * | 8/1987 | Meyer | 297/42 X |
| 4,836,601 | A | * | 6/1989 | Cone | 297/16.2 |
| 6,062,648 | A | * | 5/2000 | Adler | 297/44 X |

* cited by examiner

*Primary Examiner*—Peter M. Cuomo
*Assistant Examiner*—Rodney B. White
(74) *Attorney, Agent, or Firm*—Kramer, Levin, Naftalis & Frankel LLP

(57) ABSTRACT

A folding chair includes collapsible rungs permitting folding in two directions. Stability is further enhanced by the upholstery which further forces the top rung of the chair downward making the chair rigid in the open position. Side rails and back supports slide freely along the chair's rear legs creating a folding mechanism that folds the seat upwards while also pulling the rear leg upwards in the same direction resulting in greater stability without increasing the height of the folded package.

15 Claims, 11 Drawing Sheets

FOLDING CHAIR

The present application is a continuation-in-part of Ser No. 09/507,318, filed Feb. 18, 2000 patent pending.

FIELD OF THE INVENTION

The present invention relates to a folding chair, and more specifically to a portable folding chair designed to fold in two directions for easier transport and compact storage.

BACKGROUND INFORMATION

Folding chairs can be found in a wide variety of outdoor recreational settings. From beach resorts to suburban back yards, people enjoy the portability and ease of storage of these chairs.

Known to the art are chairs that fold in two directions, often referred to as a quad chair, i.e., the seat folds in towards the back rests and the sides fold in towards each other. However, prior art chairs that fold in two directions achieve their compactness by eliminating rungs from the back rest and seat frames, with the primary support for a user being provided by the upholstery. This decreases the level of seat and back support, sacrificing comfort and stability.

Also known to the art are folding chairs that employ longer rear legs which extend rearward past the back rest. This design provides greater stability to the unfolded chair. However, prior art folding mechanisms fold the seat upward and push the rear leg downwards in the opposite direction. The result is a taller, less compact package when the chair is folded.

Thus there exists a need in the art for a chair that folds in two directions into a compact package that also provides enhanced seat and back support. There is also a need in the art for a chair that provides the stability offered by a rear leg that extends past the back of the chair and that also folds into a shorter package.

SUMMARY OF THE INVENTION

A folding chair, according to an exemplary embodiment of the present invention, makes use of collapsible rungs, permitting the chair to fold compactly in two directions while providing better back and seat support than is found in the prior art. Stability is further enhanced in the present invention by the chair's upholstery which, when mounted, further forces the top rung of the chair downward, making the chair very rigid in the open position, especially when being used. Moreover, the side rails and back supports slide freely along the chair's rear legs, creating a folding mechanism that folds the seat upward while also pulling the rear leg upward in the same direction. Thus the rear legs extend past the back of the chair for greater stability in the unfolded state without increasing the height of the chair in its folded state, resulting in a compact package.

DETAILED DESCRIPTION OF THE INVENTION

Various aspects of the present invention will be described, and for purposes of explanation, specific configurations and details are set forth in order to provide a thorough understanding of the present invention. However, it will be apparent to one skilled in the art that the present invention may be practiced without these specific details. Furthermore, well known features have been omitted or simplified in order to prevent obscuring the present invention.

Figure 1:
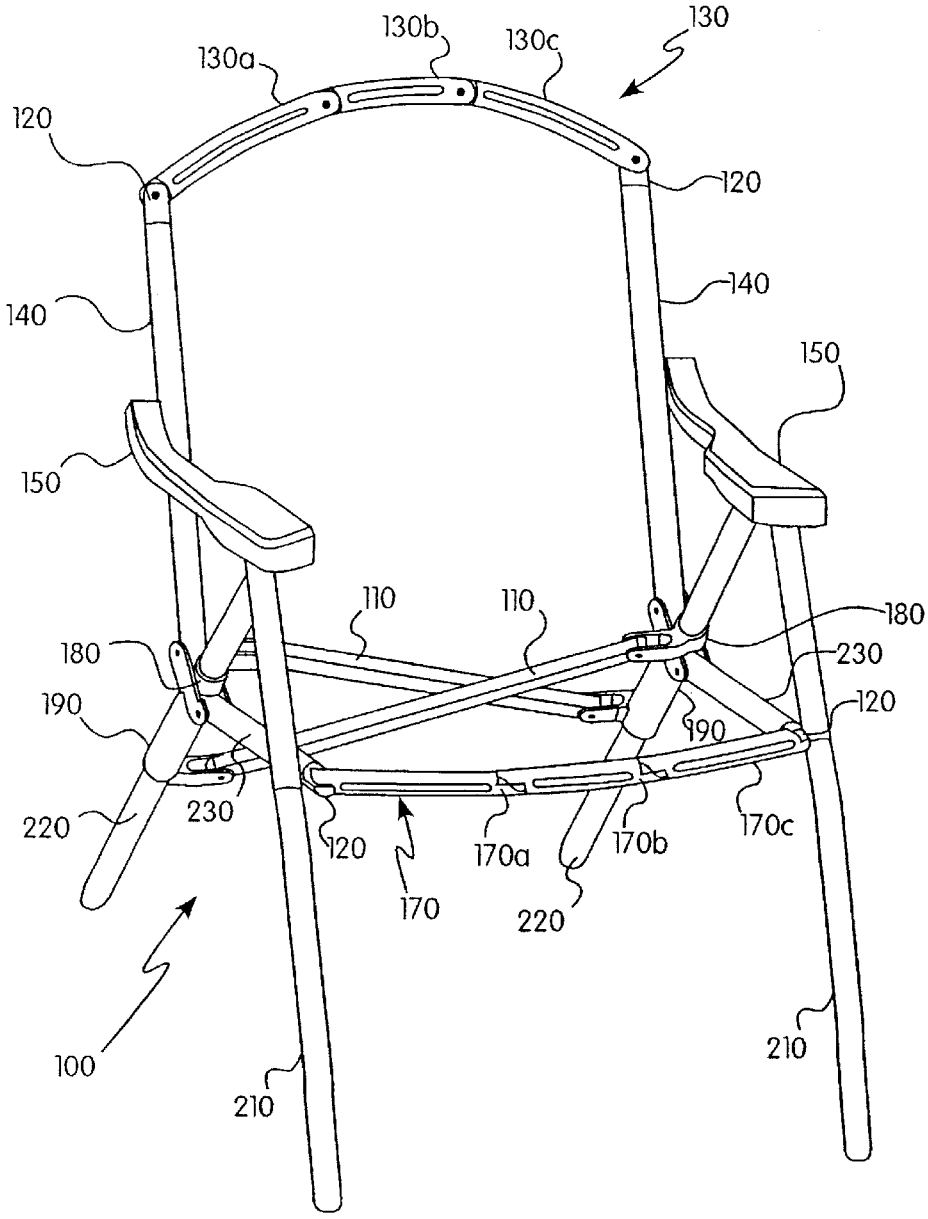
FIG. 1 illustrates a front view of a folding chair in its unfolded state according to an exemplary embodiment of the present invention.
Figure 2:
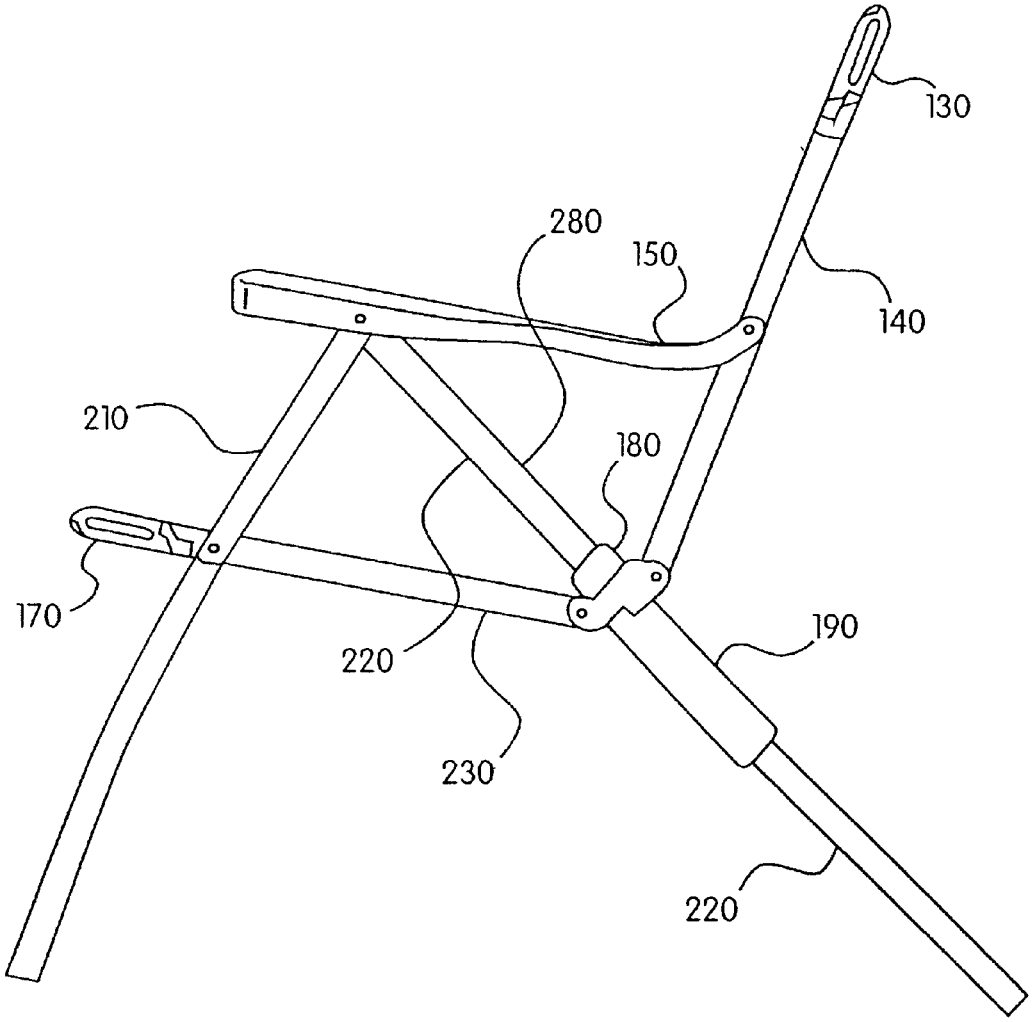
FIG. 2 illustrates a side view of a folding chair in its unfolded state according to an exemplary embodiment of the present invention.

According to an exemplary embodiment of the present invention, FIGS. 1 and 2 depict a folding chair 100 in its unfolded state. Top rung 130 and center rung 170 are each made up of, for example, three separate segments 130*a–c* and 170*a–c*, respectively, pivotally connected to one another with releasably lockable hinge joints 300. A releasably lockable hinge joint 300 may be a tendon joint, depicted in FIG. 6, or a lap joint, depicted in FIG. 7, or any standard or suitable joint known to the art that functions as a releasably lockable hinge joint 300, indicated for example in the dotted box.

Figure 6:
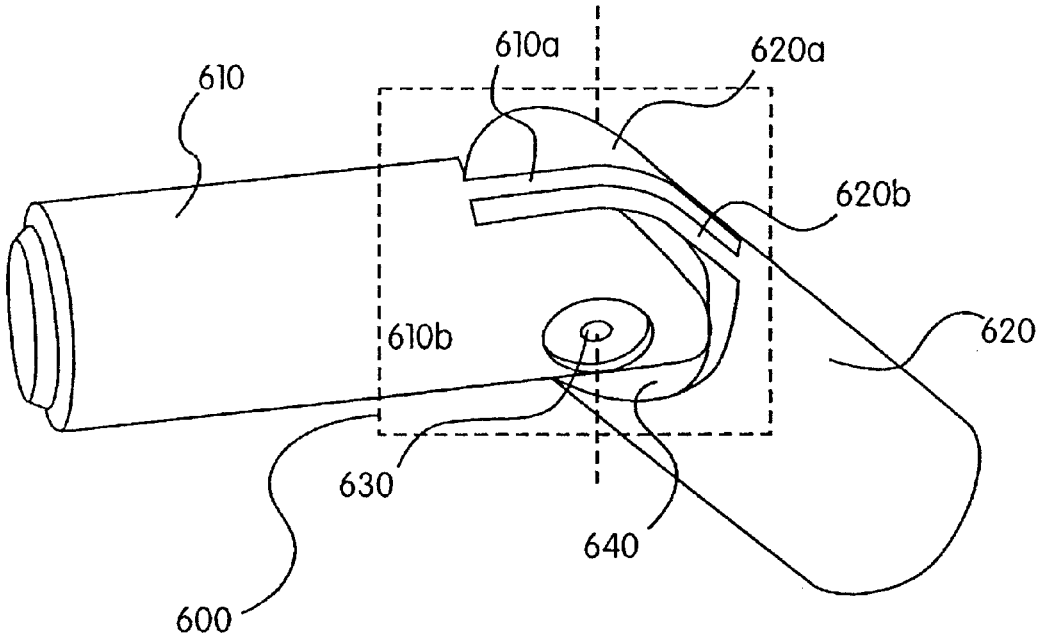
FIG. 6 illustrates a tendon joint according to an exemplary embodiment of the present invention.
Figure 7:
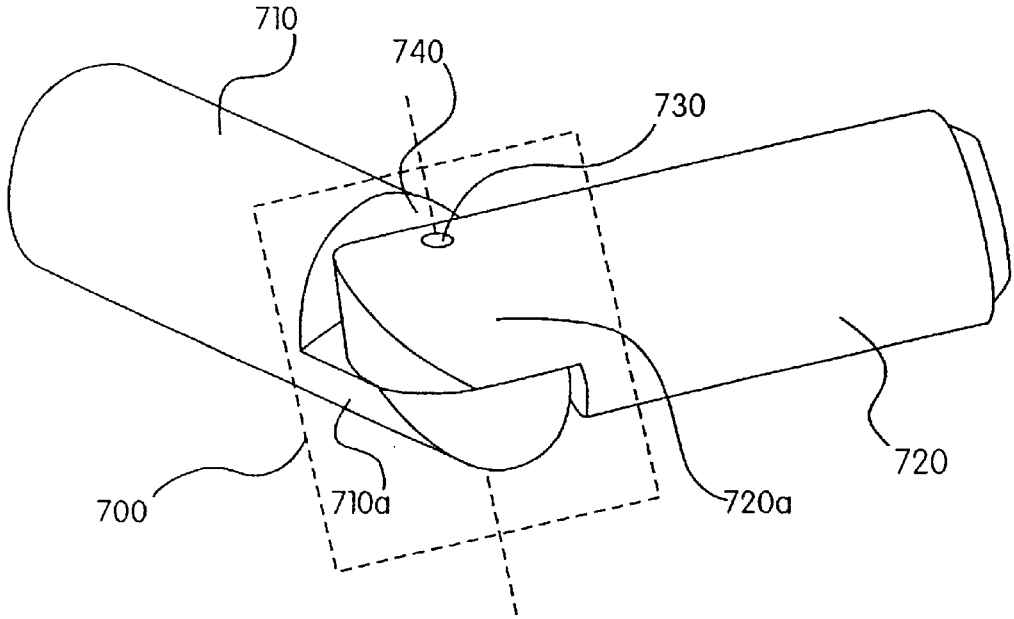
FIG. 7 illustrates a lap joint according to an exemplary embodiment of the present invention.

Referring to FIGS. 6 and 7, a lap joint differs from a tendon joint in the type of hinge used. The hinge on a lap joint has, for example, two fingers 710*a* and 720*a* that are pivotally interconnected. The hinge on a tendon joint has, for example, four fingers 610*a–b* and 620*a–b* which pivotally interconnect by overlapping each other such that, for example, finger 610*b* fits between fingers 620*a* and 620*b*, and finger 620*b* fits between fingers 610*a* and 610*b*.

Figure 3:
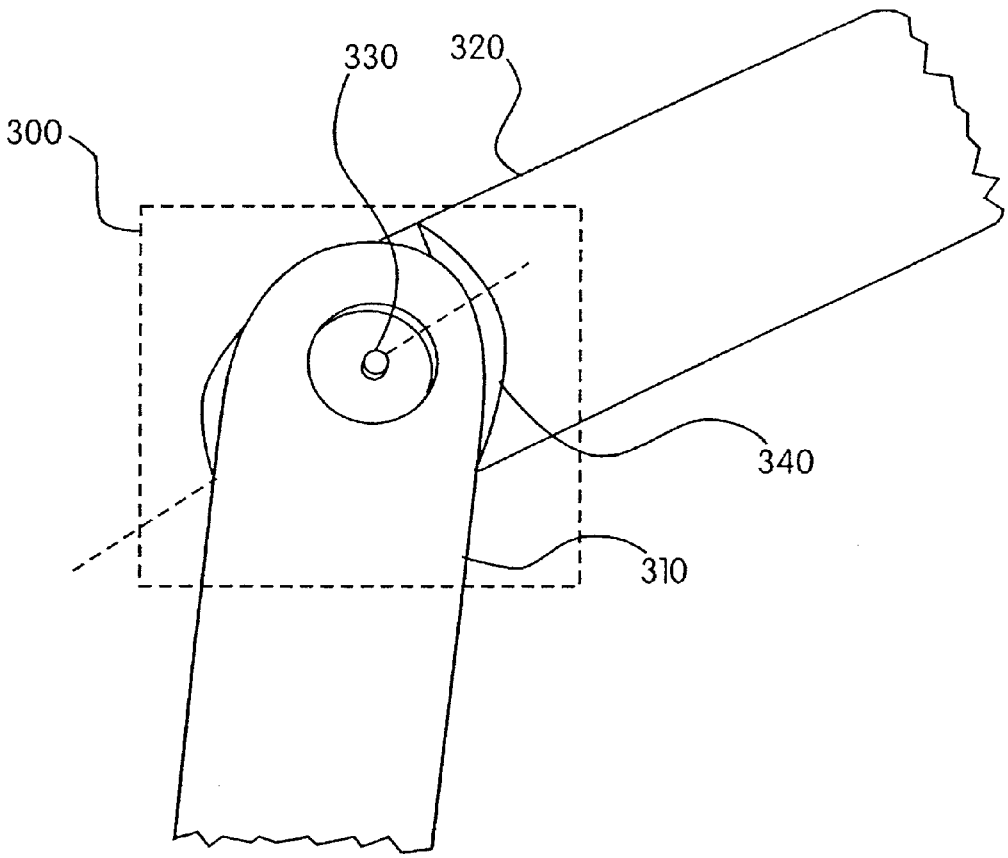
FIG. 3 illustrates a close up view of a releasably lookable hinge joint according to an exemplary embodiment of the present invention.

Each end of rung segments 130*a–c* and 170*a–c*, which may be composed of, for example, injection molded plastic or cast aluminum, are, for example, pivotally connected with releasably lockable hinge joints 300. End segments 130*a* and 130*c* and 170*a* and 170*c* are also pivotally connected by way of releasably lockable hinge joints 300 to tube caps 120, which may be composed of, for example, injection molded plastic or cast aluminum. An exemplary releasably lockable hinge joint is depicted in FIG. 3. Segments 130*a–c* and 170*a–c* are preferably curved as shown in FIG. 1, but may also be straight.

FIGS. 3, 6, and 7 depict respectively closer views of a releasably lockable hinge joint 300, a tendon joint 600, and a lap joint 700 according to an exemplary embodiment of the present invention. Segment 310, 610, 710 which may be a tube cap 120 or another rung segment (e.g., 130*b–c* or 170*b–c*), moves with respect to segment 320, 620, 720 which may also be a tube cap 120 or another rung segment (e.g., 130*a–b* or 170*a–b*), about an axis of rotation 330, 630, 730. Rotation of segment 310, 610, 710 with respect to segment 320, 620, 720 is stopped, for example, when segment 310, 610, 710 comes into contact with position block 340, 640, 740, which is, for example, a surface of a slot or notch cut into the ends of segments 310, 320, 610, 620, 710, 720 at the portion where each of the segments interconnect. For example, the slot or notch is shaped to limit the range of rotation to only one direction and to halt the rotation when a segment 310, 320, 610, 620, 710, 720 comes into contact with a side of the slotted or notched portion which serves as a position block 340, 640, 740. Thus position block 340, 640, 740 of releasably lockable hinge joint 300, 600, 700 limits the range of rotation of each of the segments 310, 320, 610, 620, 710, 720 of top rung 130 or center rung 170 with respect to one another, halting the rotation at a predetermined critical angle. The critical angle is set, for example, as a function of the dimensions of position block 340, 640, 740. Different critical angles may be employed to modify the shape of top rung 130 and center rung 170, for example, to make the rungs 130 and 170 more curved, less curved, or straight, thus varying the overall width of the chair 100.

When chair 100 is in its unfolded state, for example as shown in FIG. 1, an upward force applied to top rung 130, such as by a person pulling upward on center rung segment 130*b* of the rung 130, causes the rung segments 130*a–c* of top rung 130 to pivot or rotate with respect to one another. As a result, rung segments 130*a* and 130*c* will depend downwards from center rung segment 130*b*. Similarly, a user pulling upward or forward on center rung segment 170*b* would cause rung segments 170*a* and 170*c* to depend downward from rung segment 170*b*.

By contrast, when a downward force is applied to top rung 130 or a rearward force is applied to rung 170, the movement of the rung segments 130*a–c* or 170*a–c* is stopped by the action of position blocks 340 of releasably lockable hinge joint 300.

Thus, for example, in the unfolded state, top rung 130 will remain rigid in response to a force applied to the rung in a downward direction, and will bend in response to a force applied in the upward direction. Similarly, center rung 170 will remain rigid in response to a force applied to rung 170 in a rearward direction, but will collapse in response to a force applied in the forward direction. According to an embodiment of the present invention, movement of rungs 130 and 170 in the upward direction to fold the chair cause movement of the seat portion toward the back portion as well as movement of the arm portions of the chair towards each other.

A back rest according to an exemplary embodiment of the present invention is made up of, for example, two back supports 140, which may be composed of, for example, aluminum tubing. The top ends of back supports 140 are, for example, rigidly connected to a tube cap 120 which is in turn pivotally connected to the ends of a top rung 130 by way of a releasably lockable hinge joint 300. A seat frame is made up of, for example, two side rails 230, which may be composed of, for example, aluminum tubing. The forward ends of side rails 230 are rigidly connected to tube caps 120 which are in turn pivotally connected to the ends of a center rung 170 (e.g. 170*a*, 170*c*) by way of a releasably lockable hinge joint 300.

Referring to FIGS. 1 and 2, bottom ends of back supports 140 and rear ends of side rails 230 are, for example, each pivotally connected to a slide pivot 190. A slide pivot 190, which may be composed of, for example, injection molded plastic or cast aluminum, is disposed around each rear leg 220 such that rear legs 220 pass through slide pivots 190. Similarly, a pivot 180, which may be composed of, for example, injection molded plastic or cast aluminum, disposed around each rear leg 220, such that rear legs 220 also may pass through pivots 180.

Figure 10:
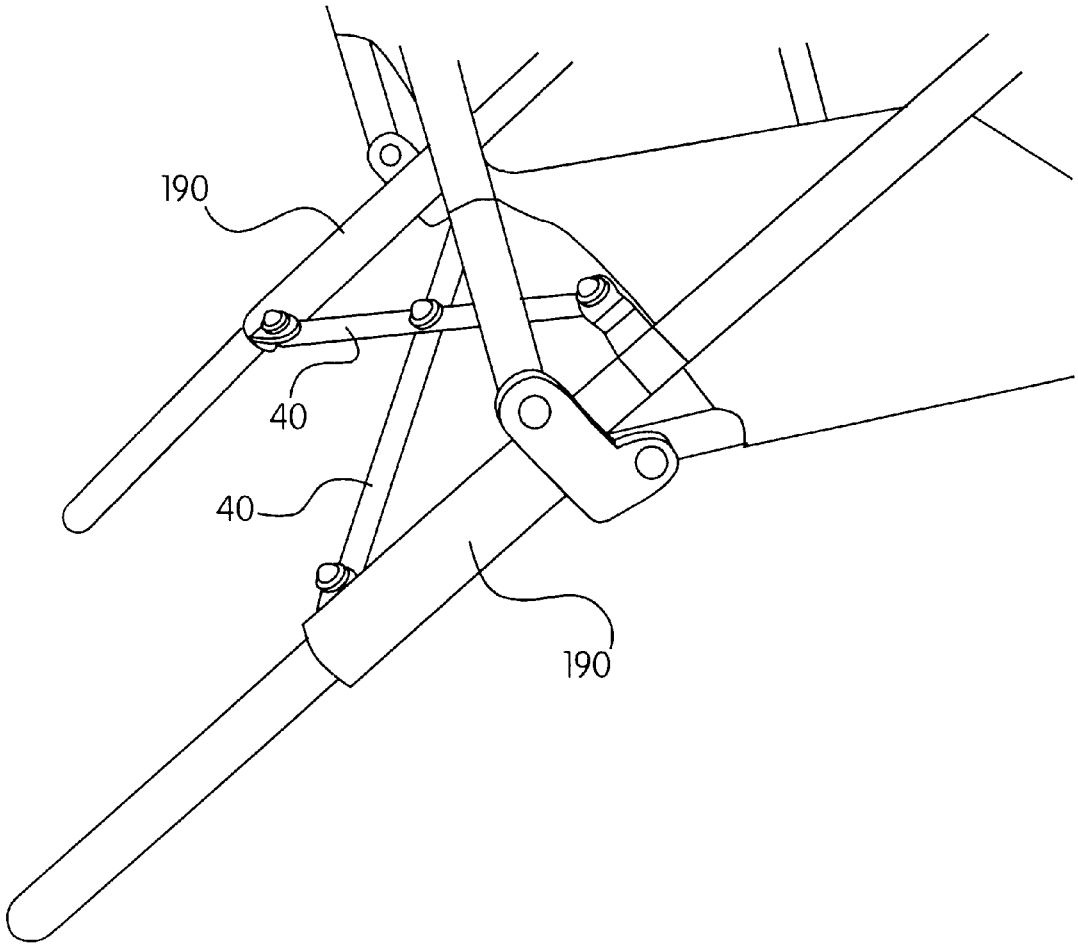
FIG. 10 illustrates a close up view of cross rails according to an exemplary embodiment of the present invention.

As can be seen from FIG. 1, each pivot 180 is, for example, pivotally connected to one end of a cross rail 110, which may be composed of, for example, aluminum tubing, and slides freely along a respective upper portion of rear leg 220. In an exemplary embodiment, crossrails 110 are composed of rectangular tubing, as depicted in FIG. 1. In alternative embodiments of the present invention a different shape of tubing may be employed, such as the crossrails 110 depicted in FIG. 10 which are composed of cylindrical tubing.

Pivotally connected to the other end of each crossrail 110 is the bottom portion of a slide pivot 190. Slide pivot 190 slides freely along the lower portion of rear legs 220. Crossrails 110 also may be pivotally connected to one another at their approximate centers. Thus, pivots 180, slide pivots 190 and crossrails 110 form a scissors-like structure that opens and closes by sliding along the rear legs 220 of chair 100. It will be apparent to one skilled in the art, that this scissors-like structure, which slides along rear legs 220, provides support by which chair 100 maintains its unfolded state, and provides the mechanism by which the sides of chair 100 fold inwards.

Front legs 210 and rear legs 220 may be composed of, for example, aluminum tubing. The top ends of rear legs 220 and the top ends of front legs 210 are, for example, pivotally connected to a forward portion of arm rests 150 such that each front leg 210 shares a common vertex and a common pivoting connector with a rear leg 220. The rear portion of arm rests 150 are pivotally connected, for example, to the center portion of back supports 140. Front legs 210 are pivotally connected, for example, to side rails 230 at the approximate front portion of side rails 230.

Figure 4:
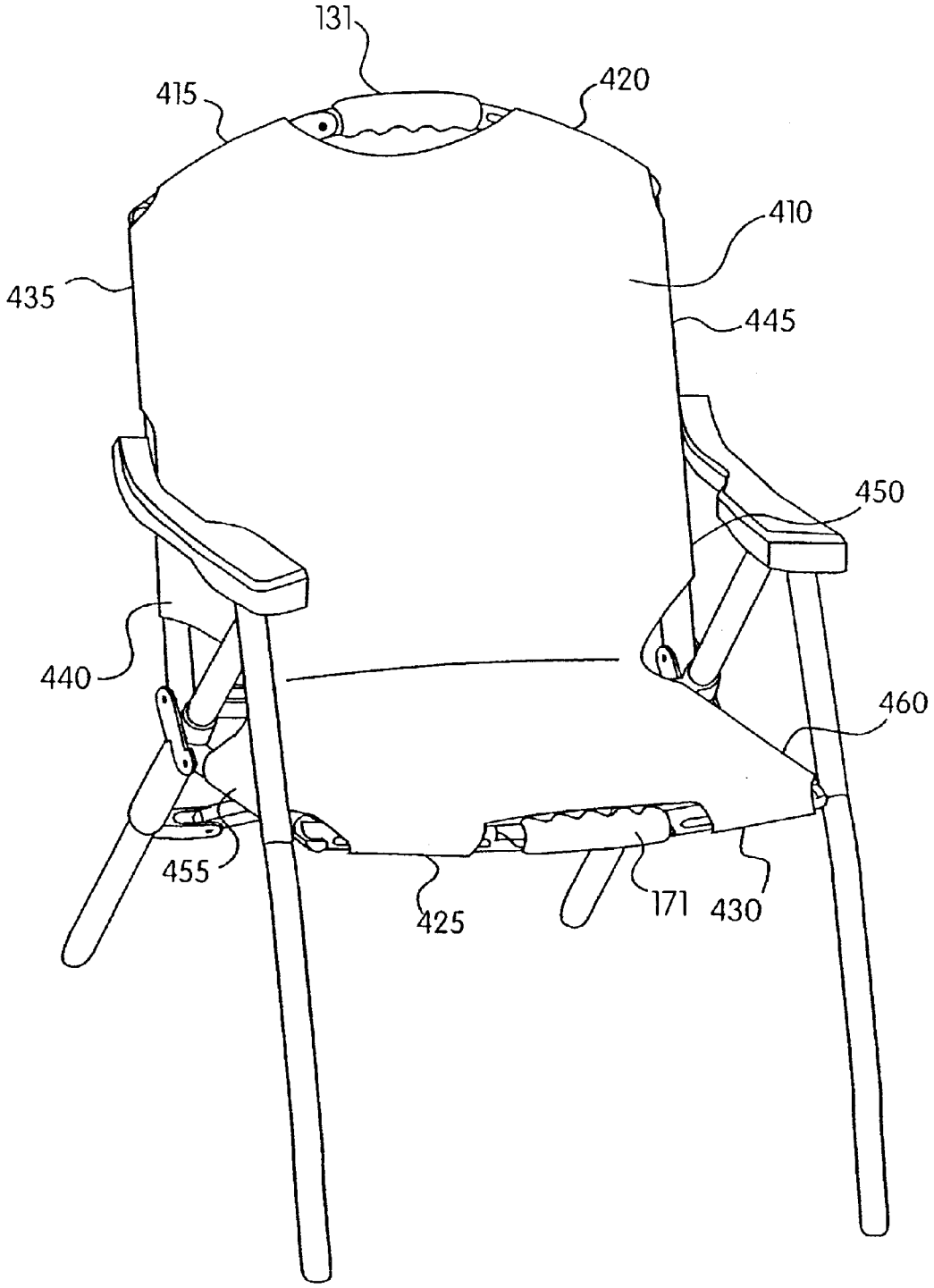
FIG. 4 illustrates a folding chair with upholstery attached according to an exemplary embodiment of the present invention.

Referring to FIG. 4, according to an exemplary embodiment of the present invention, upholstery 410, which may be composed of, for example, nylon or polyester, is fastened to top rung 130, for example, at 415 and 420, and is also fastened to center rung 170 at 425 and 430. FIG. 4 also depicts use of gripping elements 131, 171 for gripping the center rungs 130*b*, 170*b*. Upholstery 410 is further connected to back supports 140, for example using loops at 435, 440, 445, and 450, and to side rails 230 using loops at 455 and 460. Other conventional fastening means to connect the upholstery to the frame may be used. The weight of a person sitting in chair 100 further applies a downward tension to upper rung 130 at loops 415 and 420, while simultaneously applying a rearward tension to center rung 170 at loops 425 and 430. These tension forces add to the stability of chair 100, making the chair 100 very rigid in the open position when being used.

Figure 5:
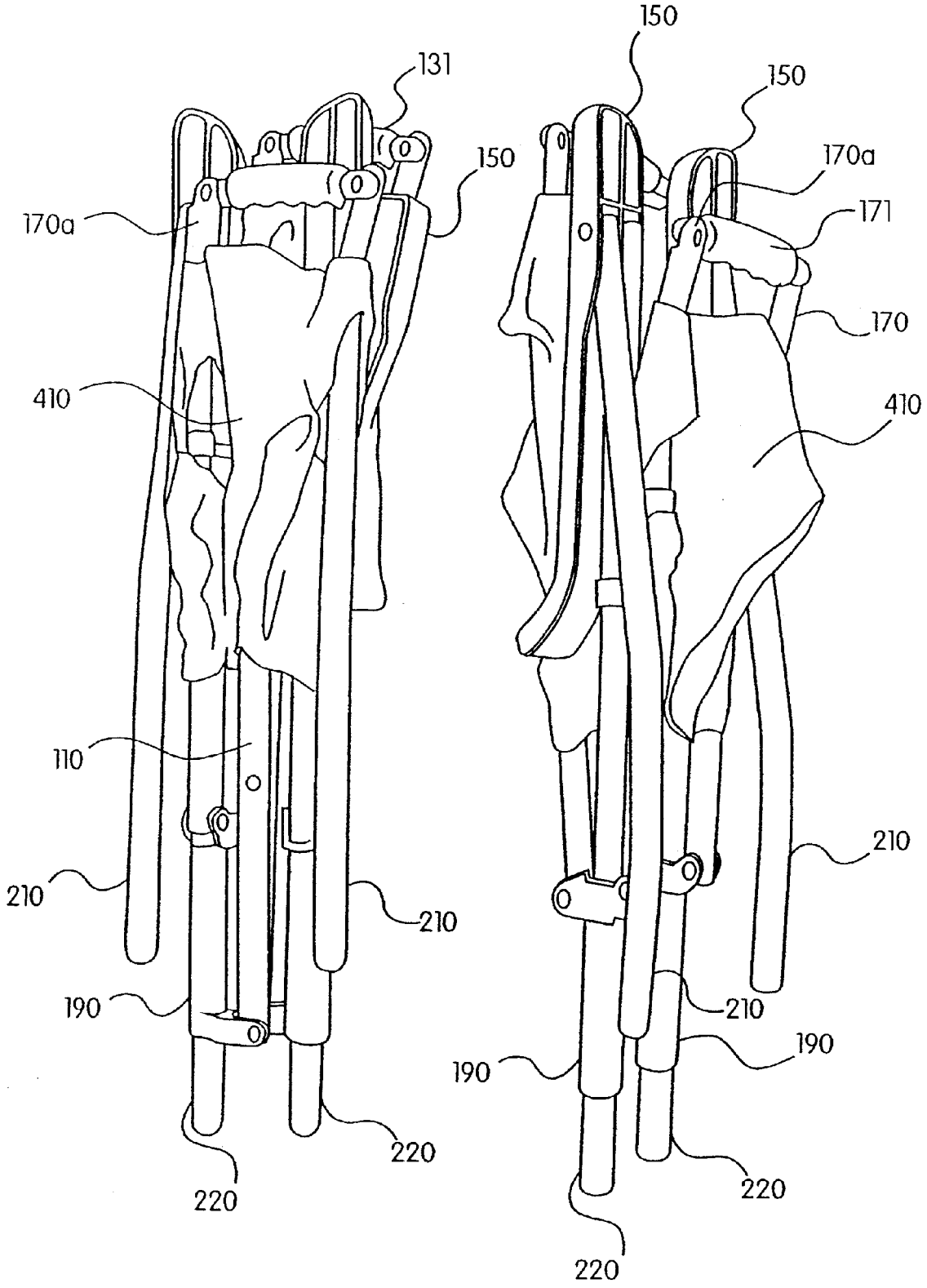
FIG. 5 illustrates a folding chair in its folded state according to an exemplary embodiment of the present invention.

As illustrated in FIG. 5, according to an exemplary embodiment of the present invention, folding chair 100 folds in one direction by lifting center rung 170 up towards top rung 130 until side rails 230 are substantially parallel and closely spaced to back supports 140. This folding action raises arm rests 150 to a position substantially parallel to and closely spaced to side rails 230 and back supports 140, while pulling rear legs 220 upward through slide pivots 190. As rear legs 220 slide upward through slide pivots 190 and pivots 180, front legs 210 pivot towards rear legs 220 such that legs 210 and 220 are substantially parallel and closely spaced to one another. FIG. 5 illustrates a folding chair in the folded state.

Lifting center rung 170 up towards top rung 130 simultaneously releases any tension applied by the upholstery to upper rung 130 and center rung 170. This allows rungs 130 and 170 to fold, the right and left segments (e.g. 170*a*, 170*c*, 130*a*, and 130*c*) of the rungs bending towards each other until the segments are substantially parallel to one another and substantially perpendicular to the center segments.

As rungs 130 and 170 fold, rear legs 220 move inwards towards each other, causing the top end of each crossrail 110 to slide upward along rear leg 220 via pivot 180, and the bottom end of each crossrail 110 to slide downwards along rear legs 220 via the attachment to slide pivot 190. Since crossrails 110 also may be pivotally connected at their approximate center, crossrails 110 pivot with respect to one another until each crossrail 110 is substantially parallel to the other, and substantially vertical with respect to the ground.

Referring to FIG. 5, the sides of chair 100 fold in towards each other, creating a very compact folded state, in which side rails 230, back supports 140, rear legs 220, front legs 210, crossrails 110, and armrests 160 are all substantially parallel and closely spaced to one another. FIG. 5 depicts the folded state of chair 100.

FIGS. 8, 9, 10 and 11 illustrate an alternative embodiment of the present invention. In this alternative embodiment, folding chair 100 folds, unfolds and operates in substantially the same manner as has been described above. However, in the alternative embodiment, the center rung 170 is, for example, coupled to a portion of front legs 210.

In this alternative embodiment, center rung 170 is again comprised of three separate segments 170*a*, 170*b*, and 170*c*, respectively, which may be composed of, for example, injection molded plastic or cast aluminum. To facilitate distinguishing between the center rung 170 of the first exemplary embodiment of the folding chair and the center rung 170 of the alternative exemplary embodiment of the folding chair, the center rung 170 of the alternative embodiment may also be referred to as a support beam that is coupled to the leg portion. Segments 170*a* and 170*c* are preferably curved but may be straight. However, in this alternative embodiment, one end of each of segment 170*a* and 170*c* is flattened and pivotally connected to a portion of each of front legs 210 respectively by way of a conventional pivot pin assembly 810. The other end of each of segment 170*a* and 170*c* is movably connected by way of releasably lockable hinge joints, for example, elbow joints 830, to either end of segment 170*b* respectively.

Figure 11:
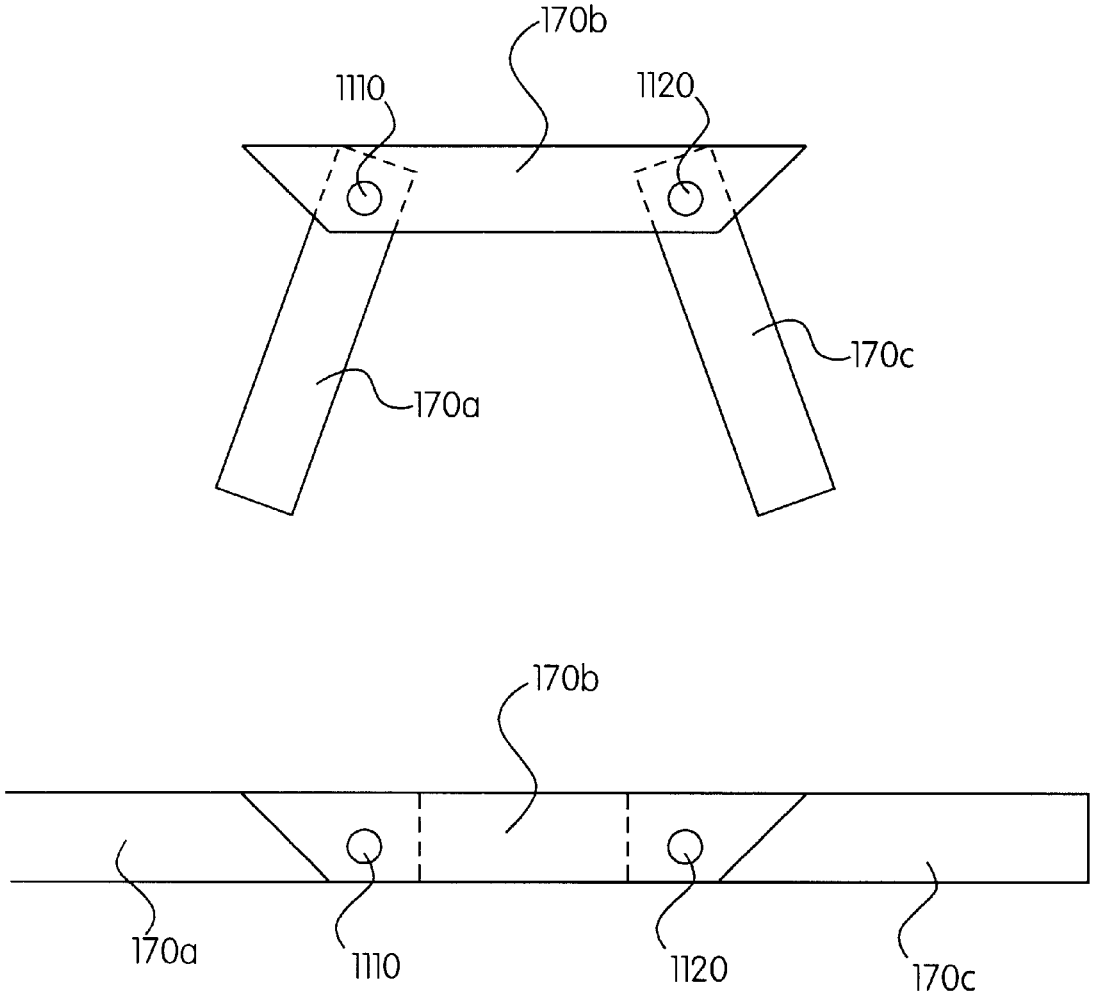
FIG. 11 illustrates a close up view of an elbow joint according to an alternative embodiment of the present invention.

FIG. 11 depicts a closer view of an elbow joint 830 according to an alternative embodiment of the present invention. Each end segment 170*a* and 170*c* moves with respect to center segment 170*b* about axes of rotation 1110 and 1120 respectively. Rotation of either end segment 170*a* and 170*c* with respect to center segment 170*b* is stopped, for example, when either end segment 170*a,c* comes into contact with a portion of center segment 170*b*. Center segment 170*b* is, for example, composed of a sheath of injection molded plastic or cast aluminum, hollow and open along its length such that center segment 170*b* fits over end segments 170*a* and 170*c* while permitting movement of segments 170*a,c* with respect to 170*b* along axes of rotation 1110 and 1120.

Center segment 170*b* further serves as a position block, halting the rotation of each of end segments 170*a* and 170*c* with respect to center segment 170*b* at a predetermined critical angle. Different critical angles may be employed to modify the shape of top rung 130 and center rung 170, for example, to make the rungs 130 and 170 more curved, less curved, or straight, thus varying the overall width of chair 100.

Figure 8:
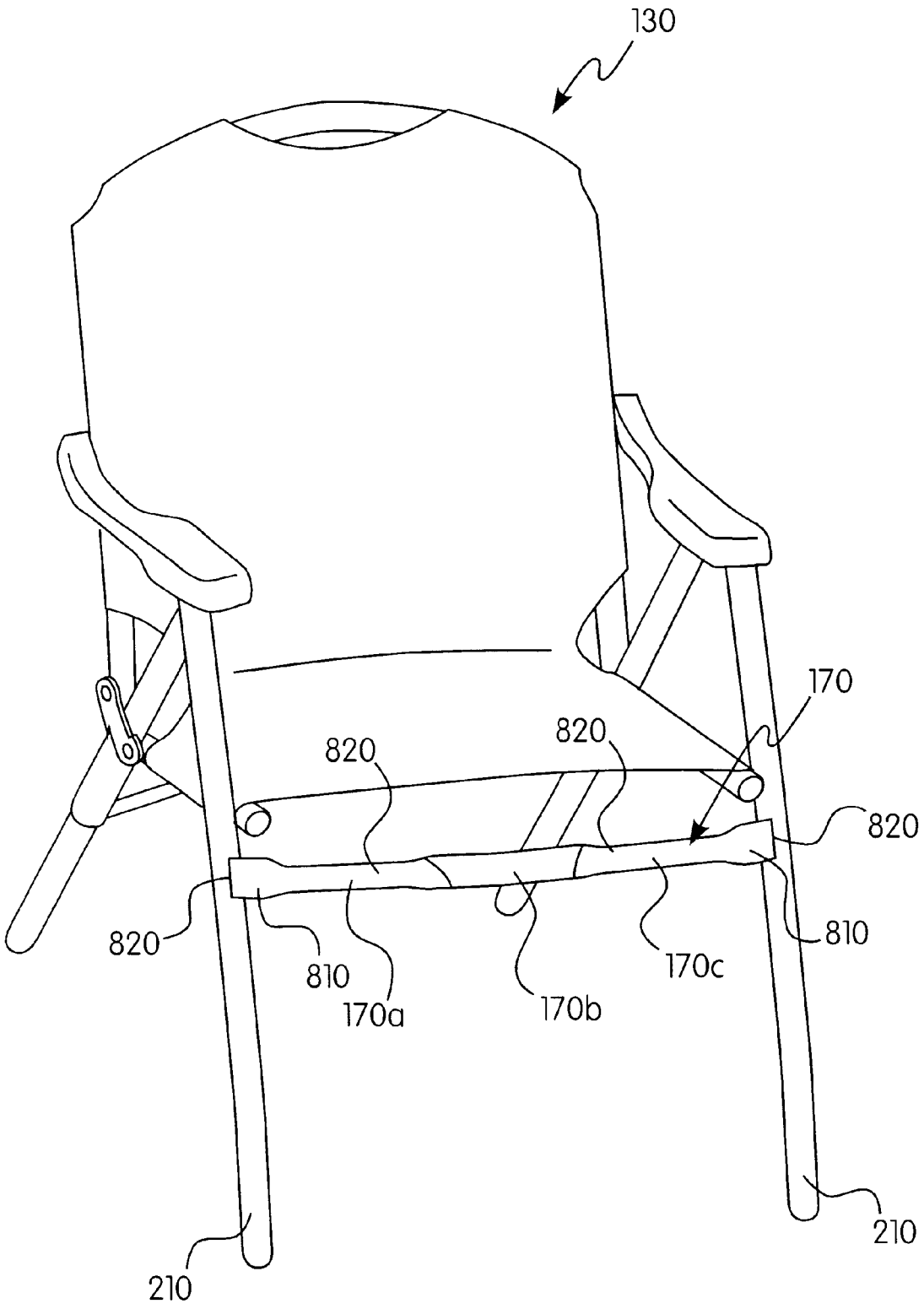
FIG. 8 illustrates a front view of a folding chair in its unfolded state according to an alternative embodiment of the present invention.
Figure 9:
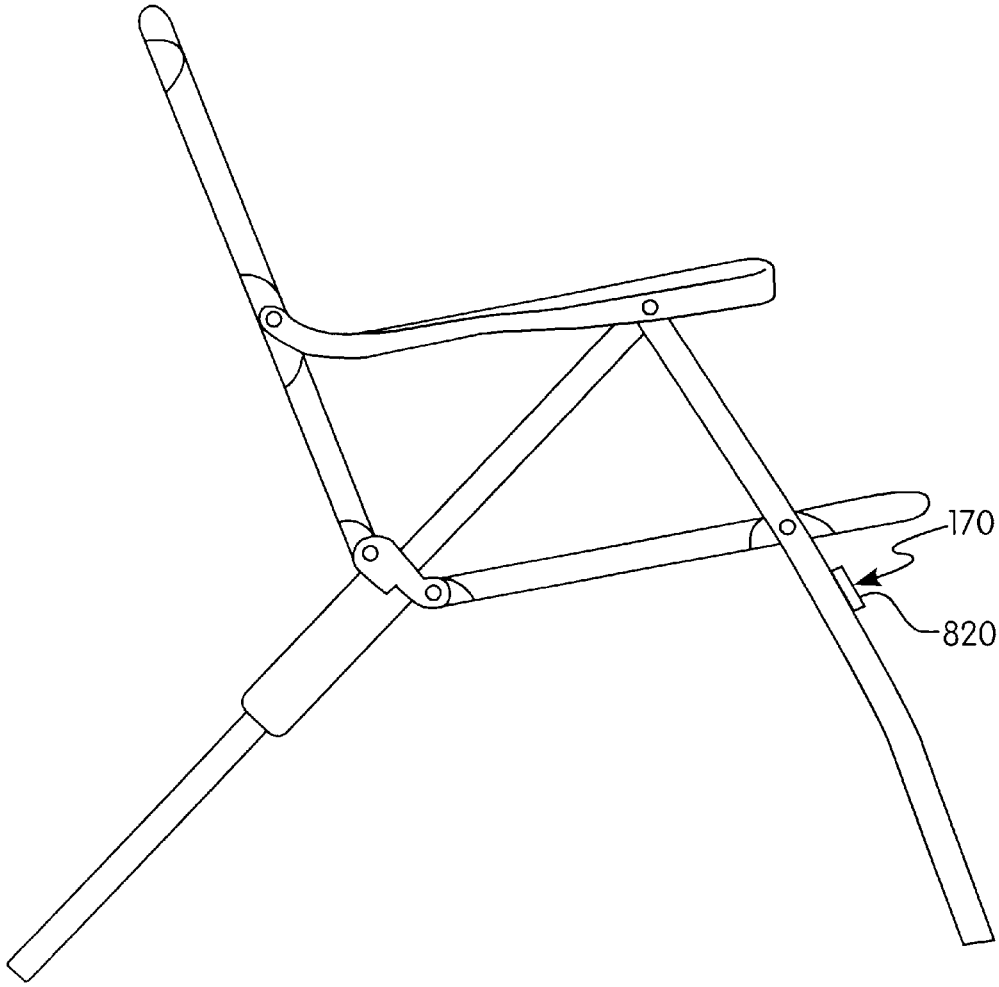
FIG. 9 illustrates a side view of a folding chair in its unfolded state according to an alternative embodiment of the present invention.

When chair 100 is in its unfolded state, for example as shown in FIGS. 8 and 9, both top rung 130 and center rung 170 remain rigid in response to a force applied in the downward direction. When fully extended, center rung 170 preferably curves downward as depicted in FIG. 8, but may alternatively be straight. Both top rung 130 and center rung 170 will collapse in response to a force applied in the upward direction, such as, for example, the pulling action of a user of chair 100.

Thus, according to this alternative embodiment of the present invention, movement of rungs 130 and 170 in the upward direction causes folding chair 100 to fold in two directions, in substantially the same manner as has been described above.

It has been shown that folding chair 100, by making use of collapsible rungs 130 and 170, folds compactly in two directions while providing better back and seat support than is found in the prior art. The stability of chair 100 is enhanced by upholstery 410, which forces top rung 130 downward making chair 100 very rigid in the open position, especially when being used. Moreover, by allowing the seat frame and back rest frame to slide along the rear leg via slide pivot 190 and pivot 180, the rear leg can be extended past the back for greater stability without sacrificing compactness.

What is claimed is:

1. A chair, comprising:

a seat portion;

a back portion including a first releasably lockable rung;

a leg portion coupled to the back portion and the seat portion;

an arm portion coupled to the leg portion; and a support beam including a second releasably lockable rung coupled to the leg portion.

2. The chair according to claim 1, wherein the first releasably lockable rung and the second releasably lockable rung each include:

a first end rung portion;

a second end rung portion; and a middle rung portion movably coupled to the first end rung portion and the second end rung portion.

3. The chair according to claim 2 wherein the middle rung portion is movably coupled via a releasably lockable hinge joint.

4. The chair according to claim 3, wherein the releasably lockable hinge joint includes slotted portions formed in each of the ends of the middle rung portion and each of the ends of the first end rung portion and the second end rung portion, the slotted portions shaped to limit the range of movement of the middle rung portion and each of the first end rung portion and second end rung portion between a folded state and releasably locked state.

5. The chair according to claim 3, wherein the releasably lockable hinge joint includes a hollow middle rung segment, having an opening along a length thereof, the opening receiving an end of each of the first end rung portion and the second end rung portion and wherein the hollow middle rung segment is shaped to limit a rotation of the hollow middle rung portion and each of the first end rung portion and the second end rung portion between a folded state and a releasably locked state.

6. The chair according to claim 3 wherein the releasably lockable hinge joint includes one of a tendon joint, a lap joint and an elbow joint.

7. The chair according to claim 2, wherein the middle rung portion includes a gripping element.

8. The chair according to claim 2, wherein the first releasably lockable rung and the second releasably lockable rung are curved.

9. The chair according to claim 1, comprising an upholstery member coupled to the first releasably lockable rung and the seat portion.

10. The chair according to claim 9, wherein the arm portion includes a first arm member pivotally coupled to the first front leg and to the first rear leg and a second arm member pivotally coupled to the second front leg and to the second rear leg.

11. The chair according to claim 10, wherein the first and second crossrail members are pivotally connected at an approximately center position.

12. The chair according to claim 9, comprising:

a first slide pivot member disposed around the first rear leg and slid ably movable along the first rear leg;

a second slide pivot member disposed around the second rear leg and slid ably movable along the second rear leg;

a first pivot member disposed around the first rear leg and slid ably movable along the first rear leg above the first slide pivot member;

a second pivot member disposed around the second rear leg and slid ably movable along the second rear leg above the second slide pivot member;

a first crossrail member pivotally connected at one end to the first slide pivot member and pivotally connected at the other end to the second pivot member; and a second crossrail member pivotally connected at one end to the second slide pivot member and pivotally connected at the other end to the first pivot member.

13. The chair according to claim 1, wherein the leg portion includes a first front leg, a first rear leg, a second front leg and a second rear leg, an upper end of each rear leg and each front leg being pivotally coupled to the arm portion.

14. The chair according to claim 1, wherein the back portion includes a first back support member and a second back support member coupled to the first releasably lockable rung, and wherein the seat portion includes a first seat support member and a second seat support member coupled to the leg portion.

15. The chair according to claim 1, wherein the first releasably lockable rung is releasable in a first direction, the back portion is movably attached to the seat portion, and the second releasably lockable rung is releasable in a second direction; and wherein the first direction differs from the second direction.

* * * * *